US006757505B2

(12) United States Patent
Amemiya et al.

(10) Patent No.: US 6,757,505 B2
(45) Date of Patent: Jun. 29, 2004

(54) IMAGE FORMING APPARATUS AND CLEANING DEVICE THEREFOR

(75) Inventors: Ken Amemiya, Tokyo (JP); Yukiko Iwasaki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/233,530

(22) Filed: Sep. 4, 2002

(65) Prior Publication Data

US 2003/0044196 A1 Mar. 6, 2003

Related U.S. Application Data

(63) Continuation-in-part of application No. 10/053,542, filed on Jan. 24, 2002.

(30) Foreign Application Priority Data

Jan. 25, 2001 (JP) ..... 2001-017150
Sep. 4, 2001 (JP) ..... 2001-268095

(51) Int. Cl.[7] ..... G03G 15/02

(52) U.S. Cl. ..... 399/100; 399/123; 399/343; 399/353; 399/357

(58) Field of Search ..... 15/1.51, 256.5, 15/256.51, 256.52; 399/100, 123, 343, 345, 347, 352, 353, 357, 358, 359, 360

(56) References Cited

U.S. PATENT DOCUMENTS 5,689,791 A * 11/1997 Swift ..... 399/353
6,470,161 B2 10/2002 Fujishiro et al.

FOREIGN PATENT DOCUMENTS

| | | |
|---|---|---|
| JP | 8-022173 | 1/1996 |
| JP | 10-020696 | 1/1998 |
| JP | 10-282854 | 10/1998 |
| JP | 11-219048 | 8/1999 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A cleaning device of the present invention includes a brush roller having a brush held in contact with the surface of a body to be cleaned. The brush contacts the surface of the body to be cleaned due to the weight of the brush roller and rotates by following the movement of the above surface. A flicker is held in contact with the brush in order to remove toner deposited on the brush. A casing forms a chamber therein for storing the toner removed by the flicker. The brush roller maintains an expected cleaning ability even when impurities deposited on the brush absorb moisture in a high-humidity environment and cannot be easily removed or when a great amount of toner deposits on the brush at a time.

16 Claims, 9 Drawing Sheets

IMAGE FORMING APPARATUS AND CLEANING DEVICE THEREFOR

The present application is a continuation-in-part of copending U.S. patent application Ser. No. 10/053,542, filed Jan. 24, 2002.

BACKGROUND OF THE INVENTION

1. Field of the Invention

The present invention relates to a copier, printer, facsimile apparatus or similar image forming apparatus and more particularly to a cleaning device for an image forming apparatus.

2. Description of the Background Art

A cleaning device for cleaning a desired member has customarily been used in machines and apparatus in various fields. An image forming apparatus, for example, includes a cleaning device for cleaning the surface of an image carrier, a cleaning device for cleaning the surface of a charge roller that charges the image carrier, and a cleaning device for cleaning the surface of an image transfer belt.

Japanese Patent Laid-Open Publication No. 7-140763, for example, discloses a cleaning device using a brush roller that contacts the surface of a member to be cleaned. The brush roller is rotated by a drive source. A brush on the brush roller and the surface of the member to be cleaned each are moved at a particular linear velocity, so that the brush scrapes off impurities deposited on the member.

However, the conventional brush roller type of cleaning device needs the drive source for driving the brush roller. Moreover, this type of cleaning device needs means for limiting the amount of bite of the brush into the desired member in order to control the permanent deformation of the brush. This increases the cost of the cleaning device and makes the cleaning device sophisticated. It is to be noted that the amount of bite of the brush refers to the maximum amount of deformation of the brush roller to occur in the radial direction when the brush is pressed against the surface of the desired member. It has been customary to control the yield of the brush by confining the amount of bite in an adequate range.

On the other hand, assume that impurities deposited on the brush of the brush roller absorb moisture in a high-humidity environment and cannot be easily removed or that a great amount of toner deposits on the brush at a time. Then, the cleaning ability of the brush roller falls with the result that a body to be cleaned is contaminated and brings about defective images. Further, to meet the increasing demand for the reduction of running cost, it is necessary to extend the lives of parts and those of units.

Technologies relating to the present invention are also disclosed in, e.g., Japanese Patent Laid-Open Publication Nos. 8-22173, 10-20696, 10-282854 and 11-219048.

SUMMARY OF THE INVENTION

It is an object of the present invention to provide a cleaning device whose brush roller maintains an expected cleaning ability even when impurities deposited on its brush absorb moisture in a high-humidity environment and cannot be easily removed or when a great amount of toner deposits on the brush at a time, thereby obviating defective images ascribable to the contamination of a body to be cleaned.

It is another object of the present invention to provide a cleaning device having a brush roller constructed into a unit for thereby extending the life of the brush roller while promoting easy, rapid replacement.

It is a further object of the present invention to provide a cleaning device having an enhanced ability to scrape off impurities deposited on a brush and achieving an extended service life.

A cleaning device of the present invention includes a brush roller having a brush held in contact with the surface of a body to be cleaned. The brush contacts the surface of the body to be cleaned due to the weight of the brush roller and rotates by following the movement of the above surface. A flicker is held in contact with the brush in order to remove toner deposited on the brush. A casing forms a chamber therein for storing the toner removed by the flicker.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
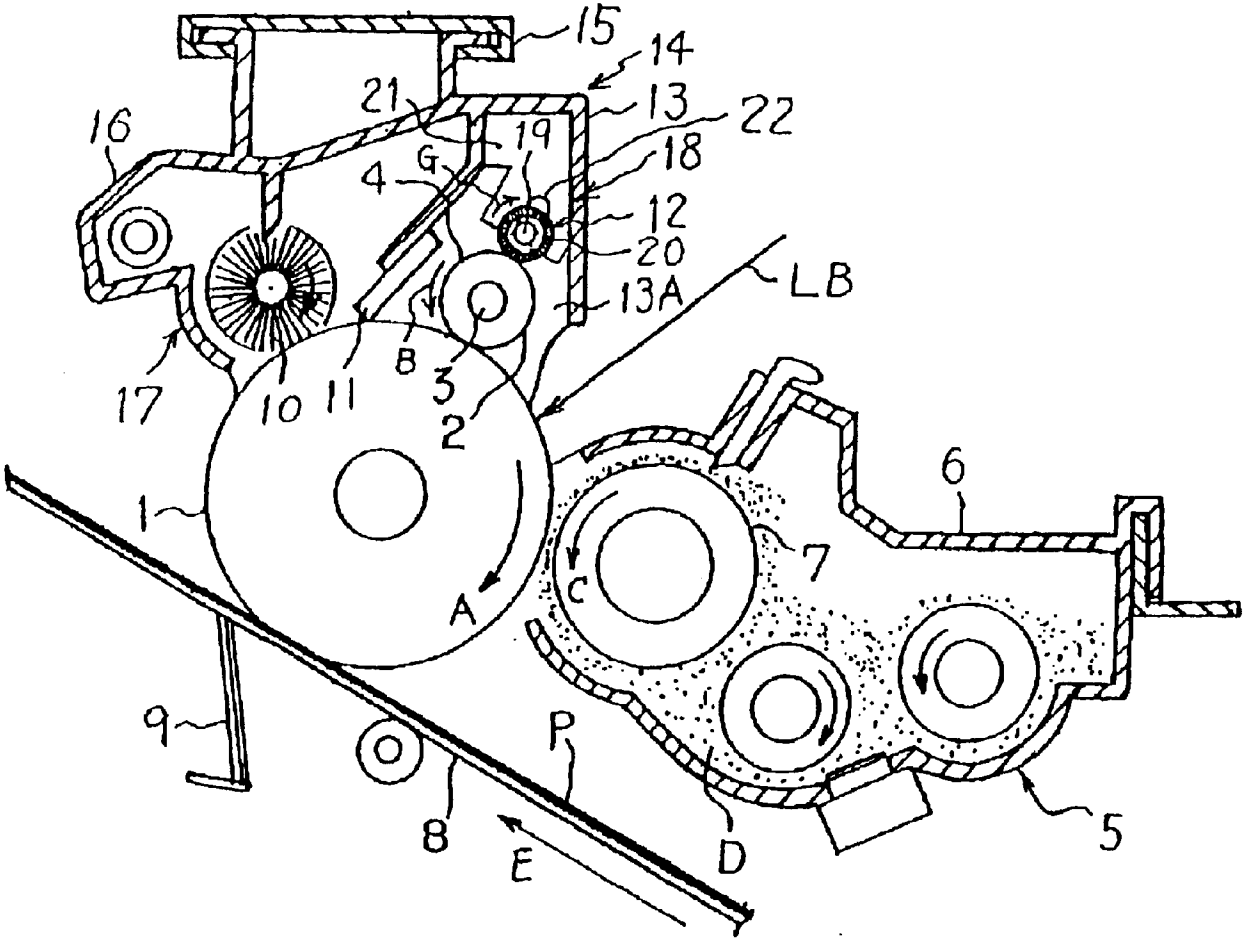
FIG. 1 is a section showing an image forming apparatus embodying the present invention.

Referring to FIG. 1 of the drawings, an image forming apparatus embodying the present invention is shown and includes a charge roller 2 to be cleaned. The image forming apparatus has one or more of an electronic copier function, a printer function, and a facsimile apparatus function. As shown, the image forming apparatus includes an image carrier implemented as a photocoductive drum 1. On the start of an image forming cycle, the drum 1 is caused to rotate in a direction indicated by an arrow A in FIG. 1. The charge roller 2 is located to face the surface of the drum 1. A drive source, not shown, or the drum 1 in rotation causes the charge roller 2 to rotate in a direction indicated by an arrow B. The charge roller 2 is made up of a metallic core 3 and an elastic body 4 affixed to the core 3. While the charge roller 2 is in rotation, a voltage of preselected polarity is applied to the charge roller 2 to thereby charge the surface of the drum 1 to the preselected polarity.

A laser writing unit, not shown, scans the charged surface of the drum 1 with a laser beam LB in accordance with image data, thereby forming a latent image on the drum 1. A developing device 5 develops the latent image with toner to thereby produce a corresponding toner image. More specifically, in the illustrative embodiment, the developing device 5 includes a casing 6 storing a powdery developer D and a sleeve 7 for conveying the developer D deposited thereon. While the sleeve 7 is rotated in a direction indicated by an arrow C in FIG. 1, toner contained in the developer is electrostatically transferred from the sleeve 7 to the latent image, developing the latent image.

An image transfer belt (simply belt hereinafter) 8 faces the drum 1 and moves in a direction indicated by an arrow E in FIG. 1. The belt 8 conveys a sheet or recording medium P fed from a sheet feed section not shown. When the sheet P passes through an image transfer position between the drum 1 and the belt 8, a voltage for image transfer is applied to an image transferring device 9, which faces the drum 1 with the intermediary of the belt 8. The image transferring device 9 electrostatically transfers the toner image from the drum 1 to the sheet P. If desired, the toner image may be transferred from the drum 1 to the sheet P by way of an intermediate image transfer body.

A cleaning brush 10 and a cleaning blade 11 remove the toner left on the drum 1 after the image transfer. On the other hand, a fixing device, not shown, fixes the toner image with heat and pressure.

In the illustrative embodiment, the image carrier, charge roller 2, cleaning brush 10 and a brush roller 12, which will be described later are rotatably mounted on a unit case 13. Further, the base end of the cleaning blade 11 is affixed to the unit case 13, completing a single unit 14. The unit 14 is movable into and out of the apparatus body along guide rails 15, as needed. The cleaning brush 10, cleaning blade 11 and a cleaning case 16, which is part of the unit case 13, constitute a cleaning device 17 for cleaning the surface of the drum 1.

As shown in FIG. 1, the charge roller 2 for charging the drum 1 is held in contact with the surface of the drum 1. Alternatively, the charge roller 2 may be slightly spaced from the surface of the rum 1, if desired.

During image forming operation, toner undesirably passed the cleaning blade 11 and impurities flying about inside the apparatus body and including toner deposit on the surface of the charge roller 2. Such toner and impurities would make the charging of the drum 1 irregular or defective and would thereby lower the image quality of the resulting toner image.

Figure 2:
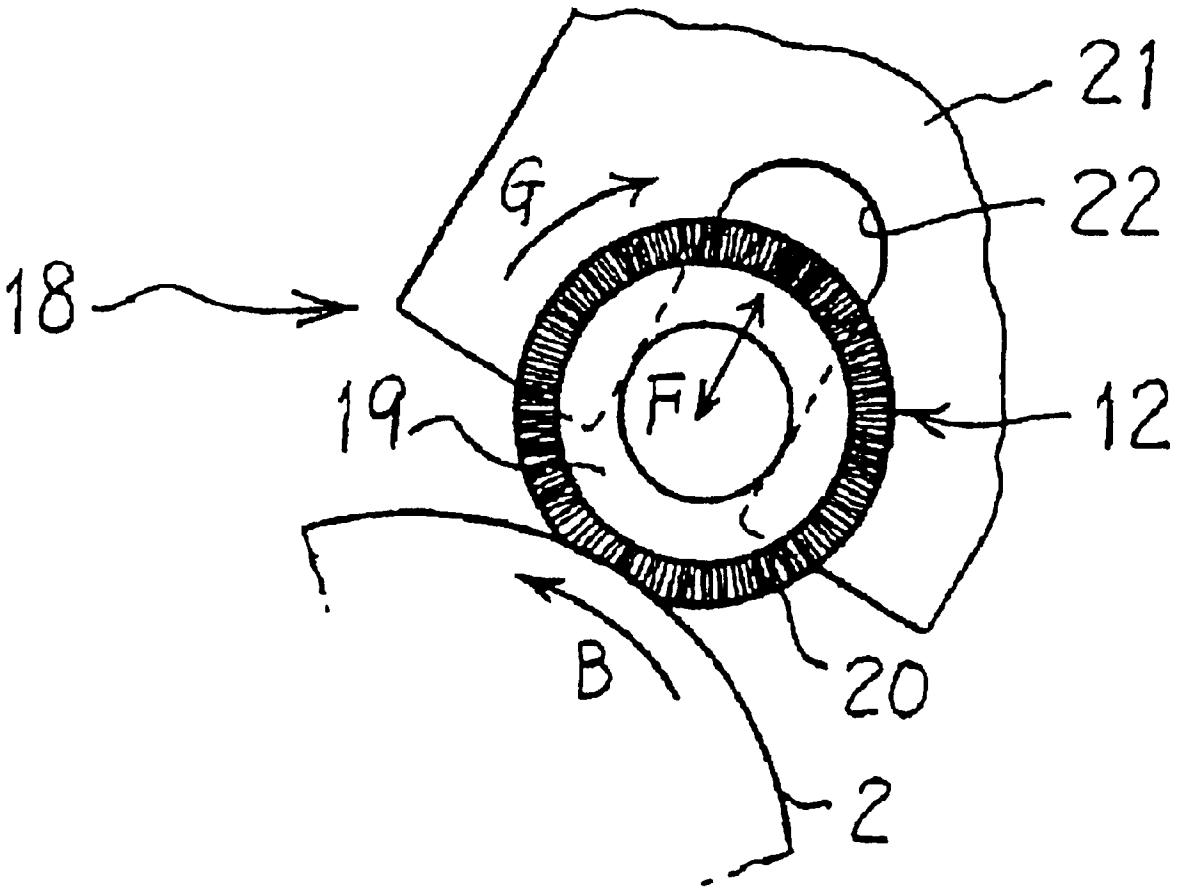
FIG. 2 is an enlarged view of a brush roller included in the illustrative embodiment.
Figure 3:
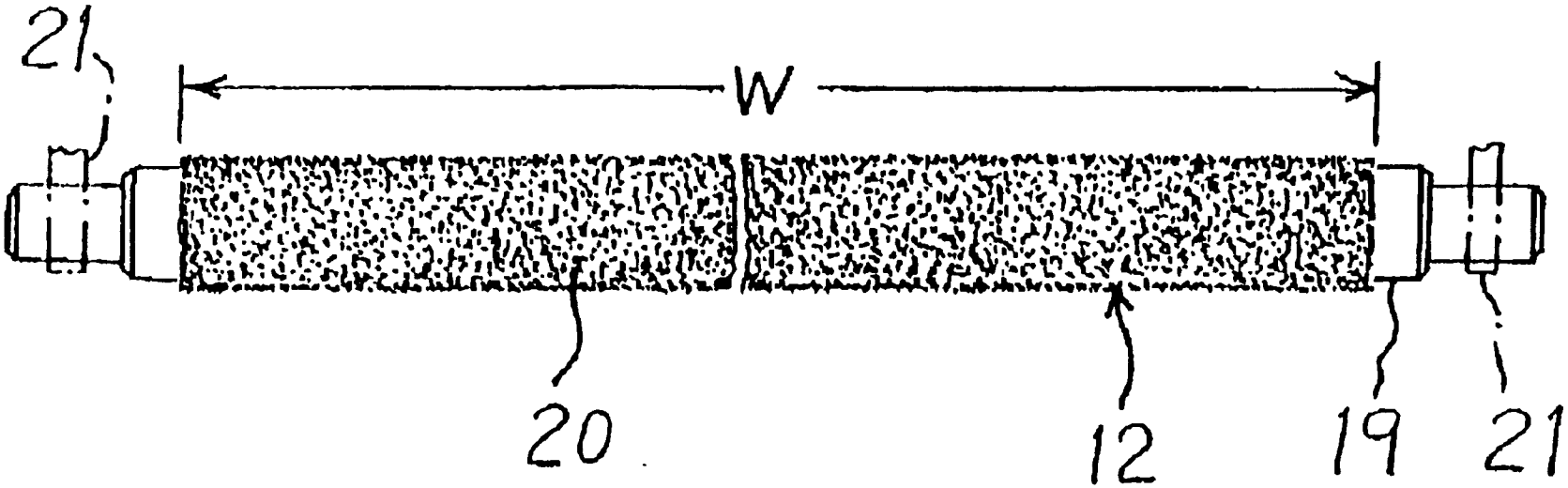
FIG. 3 is a front view showing the brush roller.

The illustrative embodiment solves the above problem with a cleaning device 18 assigned to the charge roller 2 and including the brush roller 12. The brush roller 12 extends in parallel to the charge roller 2. As best shown in FIGS. 2 and 3, the brush roller 12 is made up of a rigid core 19 formed of metal or resin and a brush 20 having a number of filaments, which are affixed to the core 19 at base portions thereof. The brush 20 extends over the entire circumference of the core 19 over an axial range W shown in FIG. 3. The brush 20 is held in contact with the charge roller 2, which is a member to be cleaned.

The brush roller 12 is configured such that the brush 20 contacts the surface of the charge roller 2 due to the weight of the brush roller 12. The charge roller 2 in rotation causes the brush roller 12 to rotate in a direction indicated by an arrow G in FIGS. 1 and 2.

More specifically, as shown in FIGS. 1 and 2, the unit case includes a rear side wall 13A and a front side wall, not shown, to each of which a bearing member 21 is affixed. A guide slot 22 is formed in each bearing member 21. Axially opposite ends of the core 19 of the brush roller 12 are respectively rotatably received in the guide slots 22 of the two bearing members 21. In this position, the core 19 is slidable along the guide slots 22 in a direction indicated by an arrow F in FIG. 2, i.e., toward and away from the charge roller 2. The guide slots 22 each have a width slightly greater than the diameter of the core 19, so that the opposite ends of the core 19 are stably received in the guide slots 22 without shaking.

The brush roller 12 is positioned above the charge roller 2. This, coupled with the fact that the core 19 is slidably received in the guide slots 22, allows the brush roller 12 to rest on the surface of the charge roller 2 due to the weight of the brush roller 12. Further, because the core 19 is rotatably received in the guide slots 22, the charge roller 2 rotating in the direction B causes the brush roller 12 to rotate in the direction G. That is, the brush roller 12 follows the rotation of the charge roller 2. In this condition, the brush 20 contacting the surface of the charge roller 2 removes the toner from the above surface.

As stated above, the brush roller 12 is not driven by a drive source, but is driven by the charge roller 2. This obviates the need for an exclusive drive source and thereby simplifies the configuration of the cleaning device 18 while reducing the cost. In addition, the brush 20 does not contact the surface of the charge roller 2 with an excessive force, protecting the surface from wear.

Assume a sum of the radius of the brush roller 12 and that of the charge roller 2 in a condition in which the rollers 12 and 2 do not contact each other, and a distance between the axis of the roller 12 and that of the roller 2 in a condition in which the rollers 12 and 2 contact each other. Then, the amount of bite of the brush 20 is produced by subtracting the above distance from the above sum. If the amount of bite is excessively great, then the filaments of the brush 20 deteriorate soon and permanently deform, i.e., yield. If the amount of bite is excessively small, then the brush 20 fails to efficiently clean the surface of the charge roller 20. It has been customary to adjust the relative position between the brush roller 12 and the charge roller 2 in such a manner as to maintain the distance between them constant, thereby limiting the amount of bite. This, however, needs extra limiting means that would increase the cost of the cleaning device while complicating the configuration.

By contrast, in the illustrative embodiment, the brush roller 12 contacts the surface of the charge roller 2 due to its own weight. It follows that a desired amount of bite of the brush 20 is achievable only if the weight of the brush roller 12 is adjusted, obviating the need for the conventional limiting means. The cleaning device 18 is therefore simple in configuration and low cost.

While the length of the filaments constituting the brush 20 is open to choice, it should preferably be 2 mm or less, more preferably 0.4 mm to 0.6 mm. It should be noted that the length of the filaments excludes the portions affixed to the core 19. The filaments with such a small length successfully reduce a bending moment to act on the base portions of the filaments although the filaments elastically bend in contact with the charge roller 2. The brush 20 is therefore free from yield or permanent deformation over a long period of time and achieves a long life. If the length of the filaments I greater than 2 mm, then the distance between nearby filaments at the tip increases with the result that the load to act on the individual filament contacting the charge roller 2 increases, aggravating the yield of the brush 20.

It is a common practice to remove toner collected by the end of the brush 20 with a flicker. In the illustrative embodiment, as shown in FIG. 1, it is possible to remove the toner from the end of the brush 20 without resorting to a flicker because the filaments of the brush 20 are short, as stated above. Why a flicker is needless is not clearly accounted for. Presumably, when the filaments of the brush 20 as short as 2 mm or less and elastically deformed in contact with the charge roller 2 leave the charge roller in accordance with the rotation of the brush roller 12, the filaments immediately restore their original position due to elasticity. The resulting shock causes the toner deposited on the tips of the filaments to jump off the filaments.

While the diameter and density of the filaments of the brush 20 are also open to choice, the diameter should preferably be 2 denier or below while the density should preferably be 20,000 filaments/$cm^2$ or above, more preferably 30,000 filaments/$cm^2$. With this configuration, a great number of filaments contact the charge roller 2 with the result that the load to act on the individual filament decreases. This is also successful to protect the brush 20 from yield over a long period of time. Further, the great number of filaments contacting the charge roller 2 can efficiently, uniformly clean the charge roller 2 for thereby insuring high image quality.

The weight of the brush 12, which is also open to choice, should preferably be 50 g or above, but 200 g or below, in order to guarantee the adequate bite of the brush 20 and smooth rotation of the brush roller 12. A weight below 50 g makes the amount of bite of the brush 20 short and thereby lowers the cleaning efficiency. A weight above 200 g makes the amount of bite excessive and thereby accelerates the yield of the brush.

The brush 20 may be affixed to the core 19 by any suitable method. When the base end of the brush 20 is affixed to the core 19 by electrostatic implantation, short filaments can be densely implanted in the core 19 and are free from yield over a long period of time. For example, adhesive may be coated on the core 19 over the axial range W, in which case a number of filaments will be electrostatically adhered to the adhesive to be affixed to the core 19 via the adhesive.

The filaments of the brush 20 may be formed of any suitable material. Experiments showed that nylon 66, PET (polyethylene terephthalate) or similar resin effectively reduced the yield of the brush 20 and insured the adequate amount of bite. If desired, the filaments may be formed of a material capable of electrostatically collecting toner from the charge roller 2 so as to further promote efficient cleaning.

Figure 4:
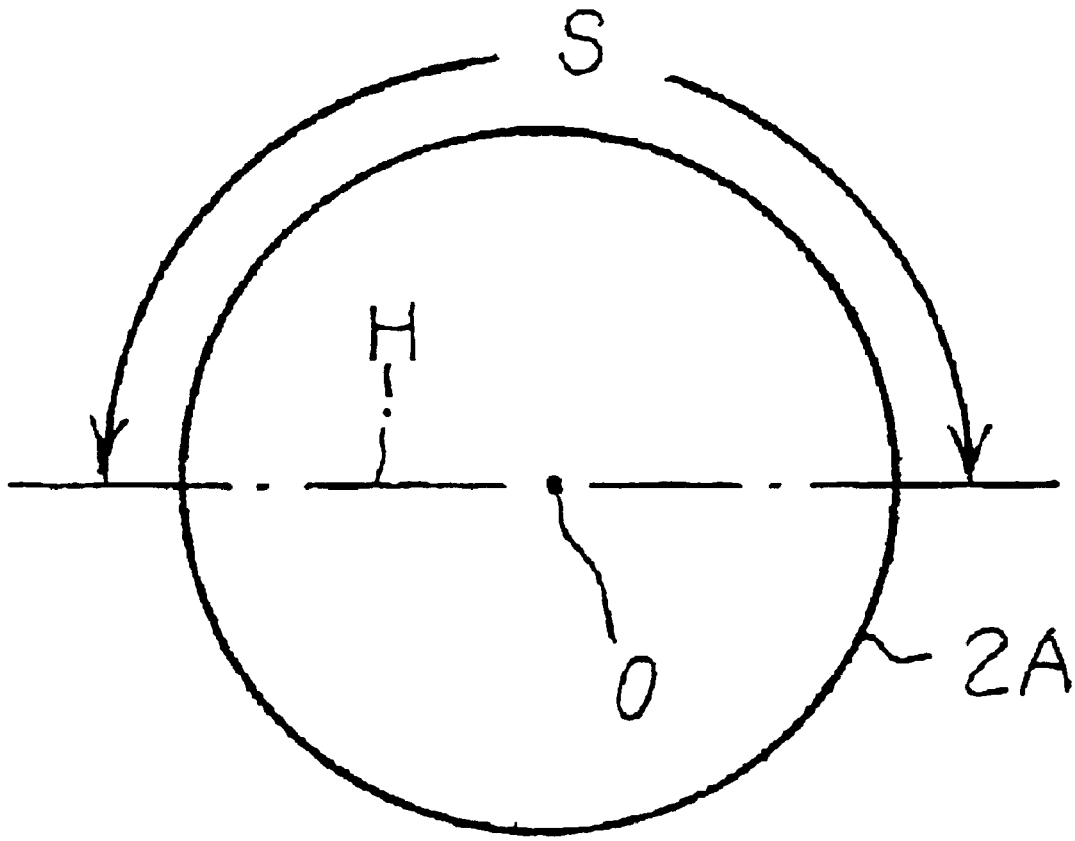
FIG. 4 is a view showing a positional relation between the brush roller and a member to be cleaned thereby.

Assume that the member to be cleaned is a cylindrical rotary body like the charge roller 2, FIG. 1. Then, as shown in FIG. 4, only if the brush roller 12 contacts a cylindrical body 2A anywhere in a range S above a horizontal plane H containing the axis O of the body 2A, the brush 20 can desirably contact the body 2A due to its own weight.

While the illustrative embodiment has concentrated on the charge roller 2, the cleaning device shown and described is similarly applicable to any one of the other members including the image carrier 1, belt 8, and intermediate image transfer body.

At least the cleaning device 18 and charge roller 2 or similar member to be cleaned may be constructed into the unit 14, as shown in FIG. 1. In this case, the brush 12 with filaments as short as 2 mm or less can be reduced in diameter and can therefore reduce the size of the unit 14. This is also true with an image forming apparatus including a cleaning device and a member to be cleaned.

Figure 5:
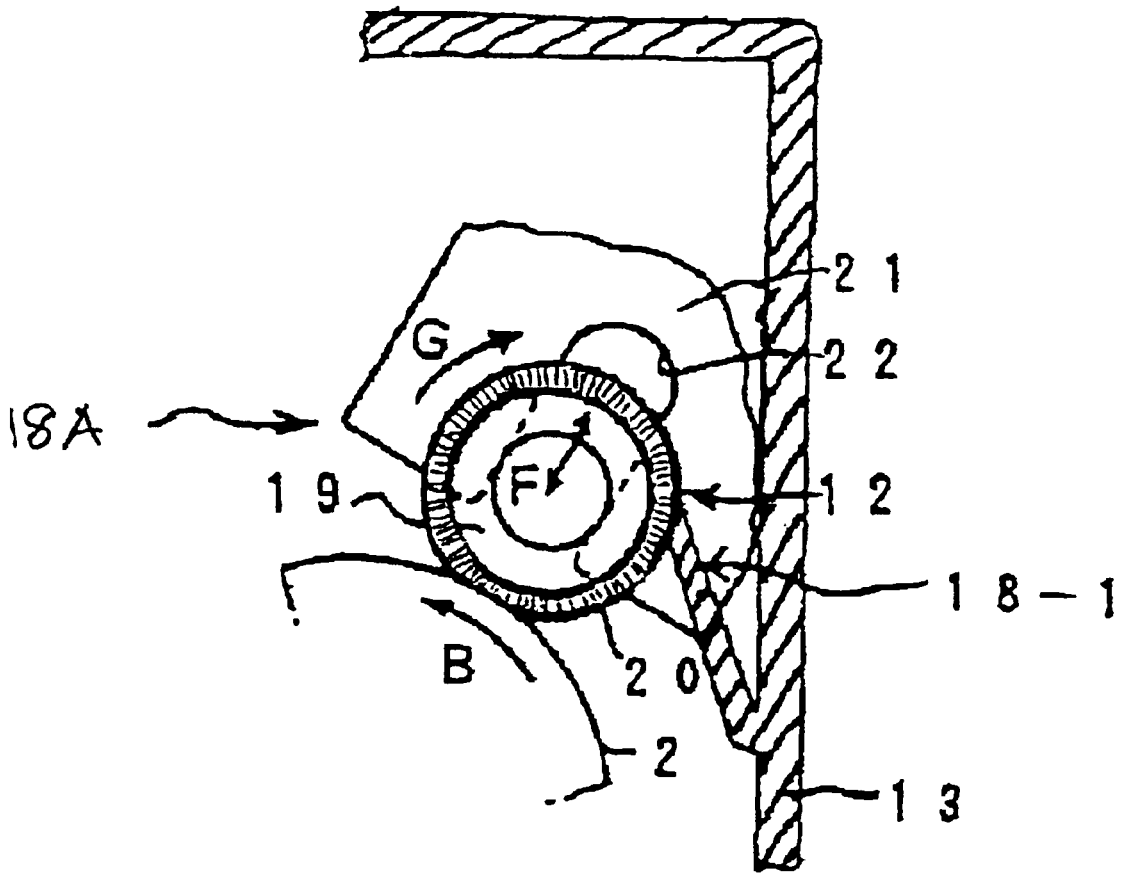
FIG. 5 is a fragmentary section showing a modification of the illustrative embodiment.

FIG. 5 shows a modification of the cleaning device 18. The structural elements of the modification identical with the structural elements of the illustrative embodiment are designated by identical reference numerals and will not be described specifically in order to avoid redundancy. As shown, the cleaning device, generally 18A, includes a rib-like flicker 18-1 extending from the inner surface of the unit case 13 into the unit case 13. The flicker 18-1 is held in contact with the circumferential surface of the brush 20 in such a manner as to slightly press the brush 20. The flicker 18-1 has a length in the axial direction of the brush roller 12 slightly greater than the width of the brush 20.

Figure 6:
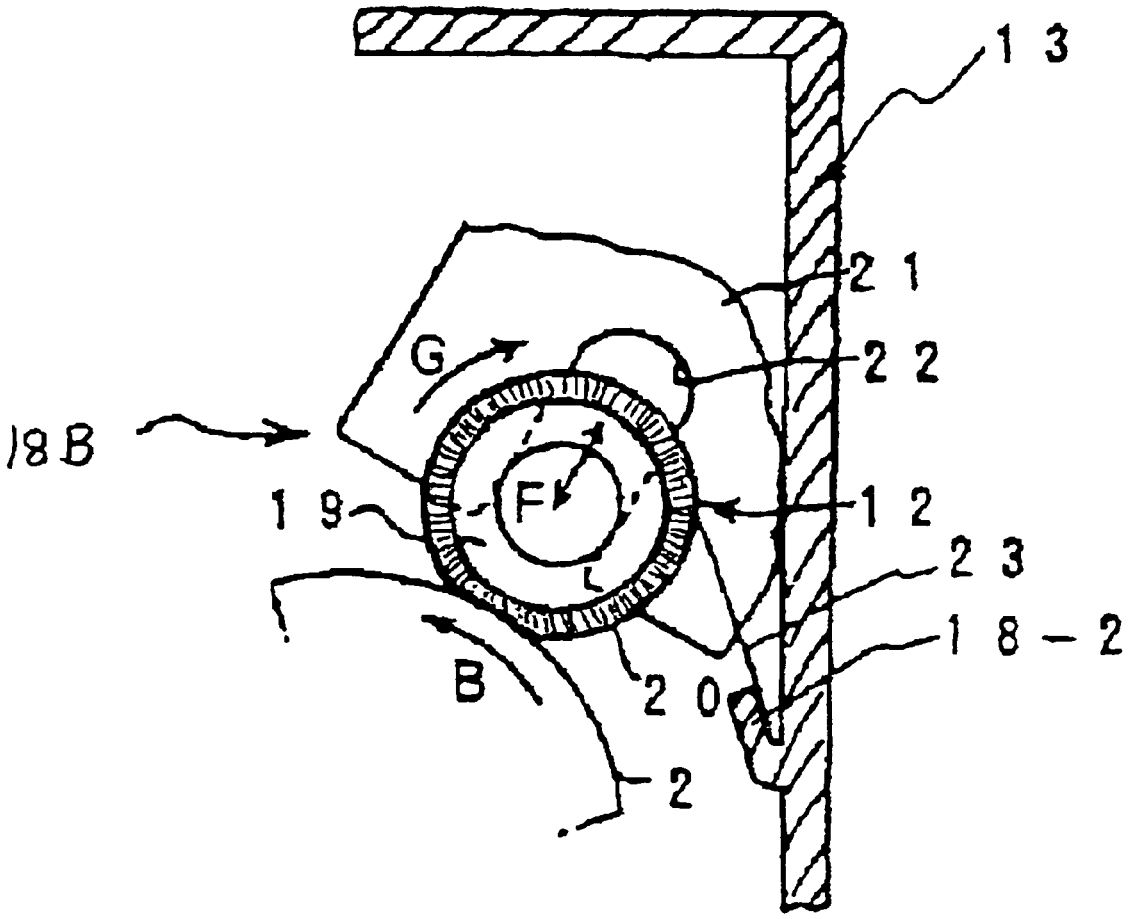
FIG. 6 is a view similar to FIG. 5, showing another modification of the illustrative embodiment.

FIG. 6 shows another modification of the cleaning device 18. The structural elements of the modification identical with the structural elements of the illustrative embodiment are designated by identical reference numerals and will not be described specifically in order to avoid redundancy. As shown, the cleaning device, generally 18B, includes a short rib 18-2 and a Mylar sheet constituting a flicker 23. The Mylar sheet is adhered to the rib 18 and held in contact with the brush 20 of the brush roller 12. The flicker 23 has a length in the axial direction of the brush roller 12 slightly greater than the width of the brush 20.

During image formation, the charge roller 2 driven by the drive source or the drum 1, as stated earlier, causes the brush roller 12 to rotate in a direction indicated by an arrow G in FIG. 5 or 6. The flicker 18-1 or 23 contacting the brush 20 scrapes off toner and other impurities deposited on the brush 20 with its edge.

In the modifications stated above, the brush roller 12 can maintain the expected cleaning ability even when impurities deposited on the brush 20 absorb moisture in a high-humidity environment and adhere to the brush 20 or when a great amount of toner deposits on the brush 20 at a time. The body to be cleaned, i.e., the charge roller 2 in the modifications can therefore be maintained clean at all times.

Figure 7:
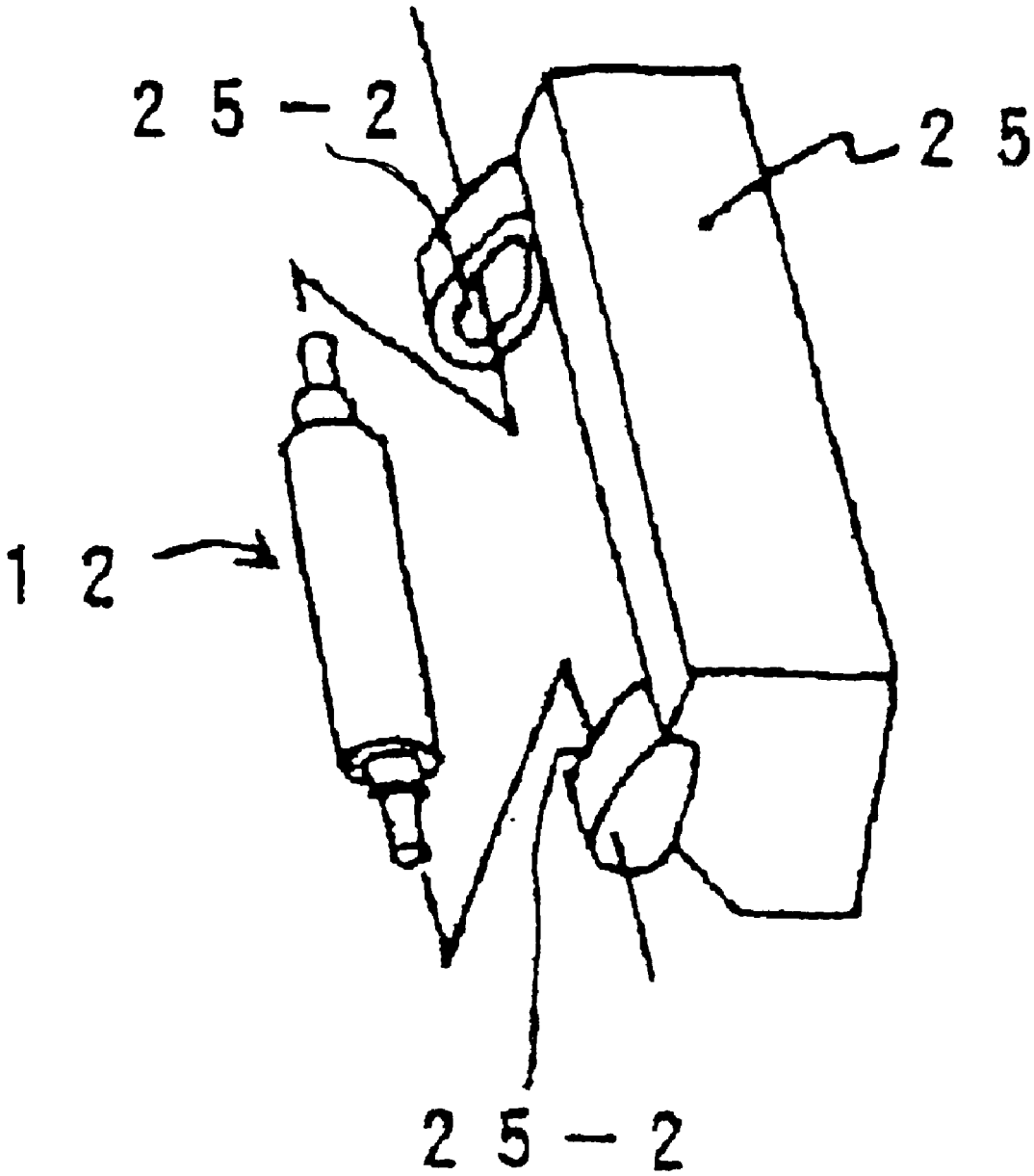
FIG. 7 is an exploded isometric view showing a cleaning unit unique to the present invention.
Figure 8:
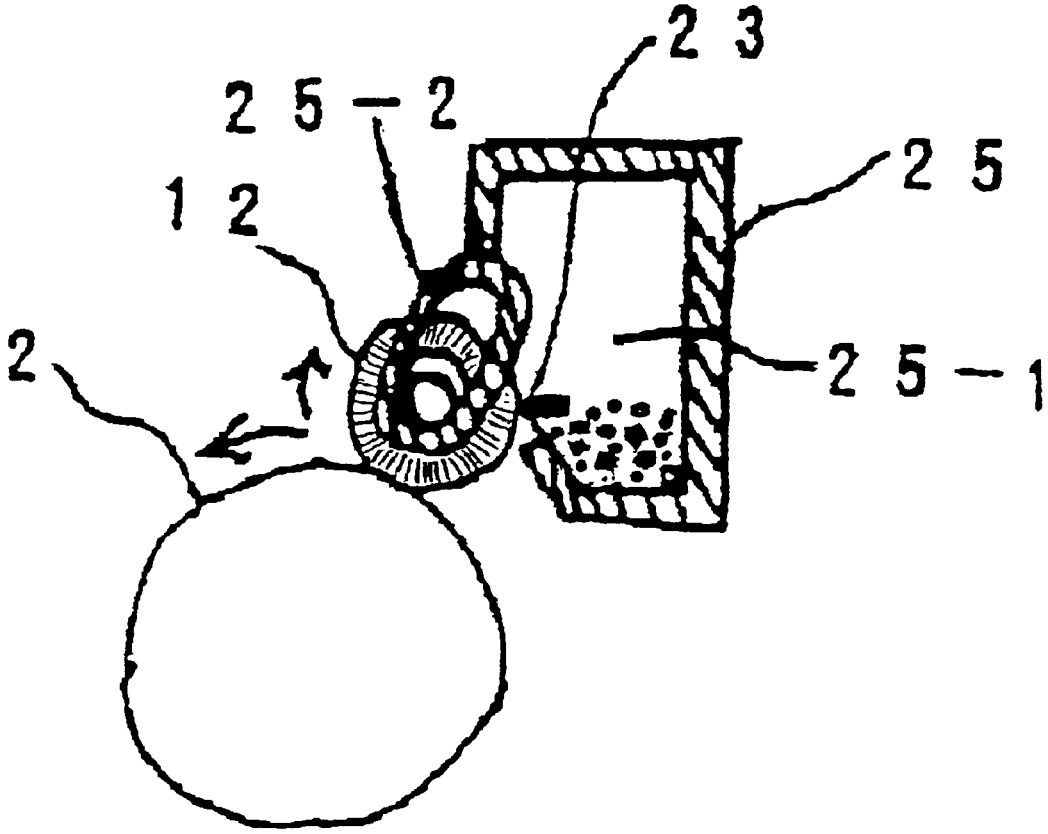
FIG. 8 is a section showing the cleaning unit of FIG. 7.

Reference will be made to FIGS. 7 and 8 for describing a cleaning unit of the illustrative embodiment. As shown in FIGS. 7 and 8, the cleaning unit is made up of the brush roller 12, a casing 25, bearing portions 25-2, and the flicker 23. The casing 25 is open at one side facing the brush roller 12 over the entire width and configured to store toner and other impurities scraped off by the brush roller 12. The bearing portions 25-2 protrude from opposite sides of the casing 25 and support the core of the brush roller 12. The flicker 23 is adhered to the lower edge of the opening of the casing 25 at its one edge and extends toward the brush roller 12. The other edge of the flicker 23 is held in contact with the brush 20 of the brush roller 12. The cleaning unit with the above configuration is removably mounted to a process cartridge including the charge roller 2.

The bearing portions 25-2 each are formed with an elongate slot extending obliquely downward from the casing 25 toward the charge roller 2. The brush roller 12 therefore tends to move downward due to its own weight, causing the brush 20 to constantly press the charge roller 2 with preselected pressure.

When image formation is effected with the cleaning unit mounted to the process cartridge, the brush roller 12 rotates in the direction G due to the rotation of the charge roller 2. The flicker 18-1 or 23 contacting the brush 20 scrapes off toner and other impurities deposited on the brush 20 with its edge. The toner and other impurities so scraped off are collected in a chamber 25-1 formed in the casing 25 and therefore do not contaminate the inside of the process cartridge or the inside of the apparatus body. This successfully extends the service life of the image forming apparatus. Further, the cleaning unit can be easily, rapidly replaced.

Figure 9:
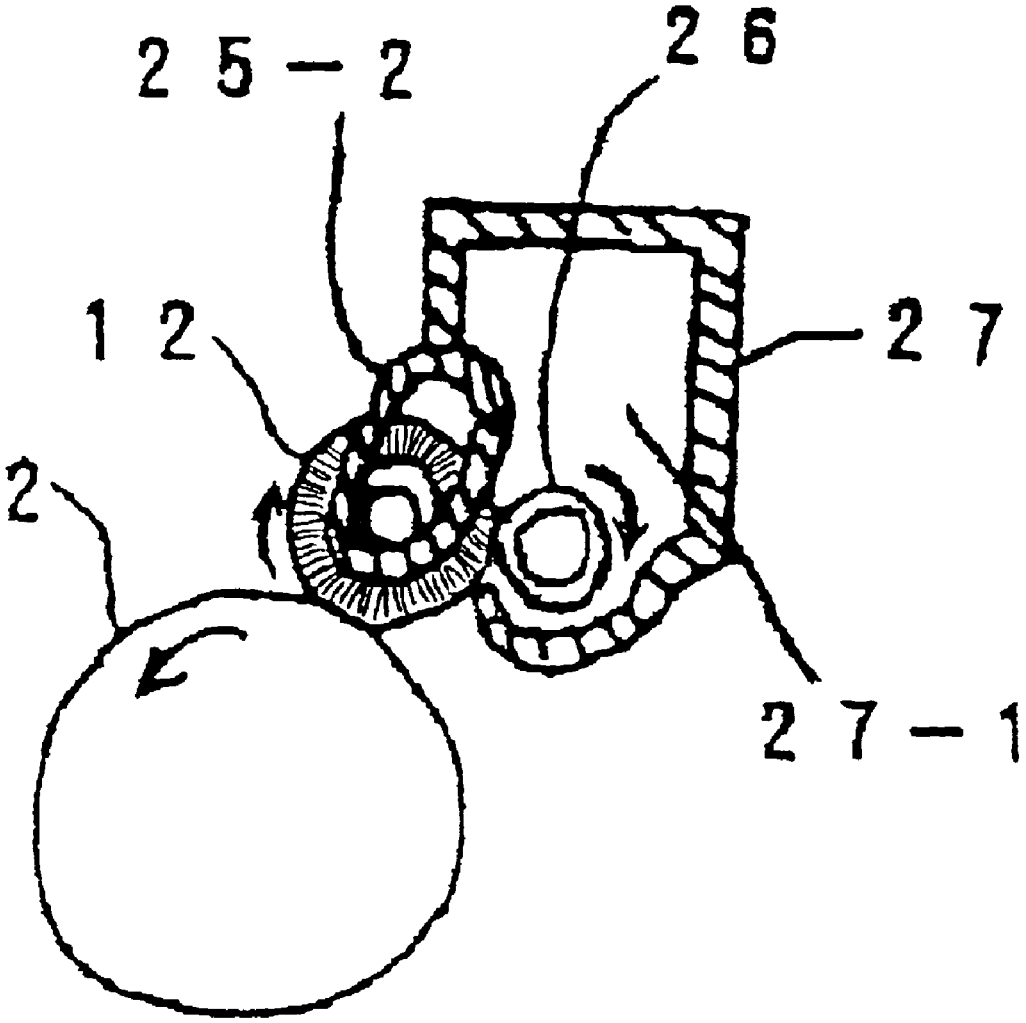
FIG. 9 is a section showing a modification of the cleaning unit.

FIG. 9 shows a modification of the cleaning unit including a flicker 26 implemented as a screw in place of the flat flicker of the configuration shown in FIGS. 7 and 8. The flicker 26 implemented as a screw has a length slightly greater than the width of the brush and is driven by drive means not shown.

In operation, the flicker or screw 26 rotates in contact with the brush 20 to thereby remove toner deposited on the brush 20. At the same time, the flicker 26 conveys the toner toward the rear end of a casing 27 in the direction perpendicular to the sheet surface of FIG. 9. The toner is introduced into a waste toner tank, not shown, disposed in the apparatus body via a hole formed in the rear end of the casing 27. It follows that brush roller 12 and the chamber 27-1 of the casing 27 can be maintained clean as if they were new. Again, the cleaning unit can be easily, rapidly replaced.

In summary, in accordance with the present invention, a flicker is held in contact with a body to be cleaned. The flicker therefore allows a brush roller to maintain the expected cleaning ability even when impurities deposited on its brush absorb moisture in a high-humidity environment and adhere to the brush or when a great amount of toner deposits on the brush at a time. The body to be cleaned can therefore be maintained clean at all times.

Further, the brush roller and flicker are constructed into a unit together with a casing. Such a unit protects the inside of a process cartridge and the inside of an image forming apparatus from contamination for thereby extending the life of the apparatus. In addition, the unit can be easily, rapidly replaced.

Moreover, when the flicker is implemented as a screw, it not only scrapes off toner, but also conveys the toner to the rear end of the casing. The toner is collected in a waste toner tank via an opening formed in the rear end of the casing. This maintains the brush roller and a chamber formed in the casing clean for thereby extending the life of the image forming apparatus and that of a cleaning unit.

Various modifications will become possible for those skilled in the art after receiving the teachings of the present disclosure without departing from the scope thereof.

What is claimed is:

1. A cleaning device comprising:

a brush roller having a brush adapted to make a contact with a surface of a body to be cleaned, said contact between said brush and said surface being due to a weight of said brush roller, said brush roller being driven to rotate due to said contact by following a movement of said surface;

a flicker contacting a tip of said brush to thereby remove toner deposited on said tip; and a casing forming a chamber for storing the toner removed by said flicker.

2. The device as claimed in claim 1, wherein said brush has filaments having a length of 2 mm or below.

3. The device as claimed in claim 1, wherein the filaments have a diameter of 2 denier or below and a density of 20,000 filaments/$cm^2$ or above.

4. A cleaning device comprising:

a brush roller having a brush that contacts a surface of a body to be cleaned, said brush contacting said surface due to a weight of said brush roller and rotating by following a movement of said surface;

a flicker contacting a tip of said brush to thereby remove toner deposited on said tip; and a casing forming a chamber for storing the toner removed by said flicker, wherein said brush roller has a weight of 50 g or above, but 200 g or below.

5. The device as claimed in claim 1, wherein the filaments have base portions thereof affixed to a core of said brush roller by electrostatic implantation.

6. The device as claimed in claim 1, wherein the member to be cleaned comprises a cylindrical rotary body, and said brush contacts a surface of said rotary body at a position above a horizontal plane containing an axis of said rotary body.

7. The device as claimed in claim 1, wherein the member to be cleaned comprises a charge roller that faces an image carrier for charging said image carrier.

8. The device as claimed in claim 1, wherein said flicker comprises a rib extending from an inner surface of said casing into said casing.

9. The device as claimed in claim 8, wherein said flicker has a length in an axial direction of said brush roller slightly greater than a width of said brush.

10. The device as claimed in claim 1, wherein said flicker comprises a rib extending from an inner surface of said casing into said casing, and a Mylar sheet adhered to said rib and contacting the tip of said brush.

11. The device as claimed in claim 1, wherein said casing is formed with an opening at a side thereof facing said brush roller, said flicker being adhered to a lower edge of said opening.

12. A cleaning device comprising:

a brush roller having a brush that contacts a surface of a body to be cleaned, said brush contacting said surface due to a weight of said brush roller and rotating by following a movement of said surface;

a flicker contacting a tip of said brush to thereby remove toner deposited on said tip;

a casing forming a chamber for storing the toner removed by said flicker, and a pair of bearing portions protruding from said casing and rotatably supporting said brush roller while guiding said brush roller such that said brush roller contacts the surface of the body to be cleaned due to its own weight, wherein said casing is formed with an opening at a side thereof facing said brush roller, and said flicker being adhered to a lower edge of said opening.

13. The device as claimed in claim 12, wherein said brush roller, said flicker and said casing with said bearing portions are constructed into a cleaning unit.

14. The device as claimed in claim 13, wherein said cleaning unit is removably mounted to a process cartridge.

15. The device as claimed in claim 11, wherein said flicker is flat.

16. The device as claimed in claim 11, wherein said flicker comprises a rotatable screw having a length slightly greater than a width of said brush.

* * * * *